US005708978A

United States Patent [19]

Johnsrud

[11] Patent Number: 5,708,978

[45] Date of Patent: Jan. 20, 1998

[54] MEDICAL VEST

[76] Inventor: Anna C. Johnsrud, 516 W. 7th St., Starbuck, Minn. 56381

[21] Appl. No.: 291,772

[22] Filed: Aug. 17, 1994

[51] Int. Cl.[6] ..... A41D 1/04

[52] U.S. Cl. ..... 2/102; 2/94; 2/247

[58] Field of Search ..... 2/94, 102, 51, 2/247, 92, 49.2, 114; D2/829

[56] References Cited

U.S. PATENT DOCUMENTS

| | | | |
|---|---|---|---|
| D. 278,090 | 3/1985 | Cochran | D2/190 |
| D. 292,840 | 11/1987 | O'Brien | D2/190 |
| D. 313,652 | 1/1991 | Lavine | D24/17 |
| 1,879,341 | 9/1932 | Lapham | 2/94 |
| 2,439,097 | 4/1948 | Pierce | 2/247 |
| 2,485,442 | 10/1949 | Halliday | 2/94 |
| 2,624,881 | 1/1953 | Lee | 2/247 |
| 2,688,752 | 9/1954 | Sbarra et al. | 2/247 |
| 2,717,391 | 9/1955 | Bracken | 2/94 |
| 3,105,241 | 10/1963 | Allen | 2/94 |
| 3,529,307 | 9/1970 | Belson et al. | 2/94 |
| 4,087,864 | 5/1978 | LaBove et al. | 2/102 |
| 4,106,121 | 8/1978 | Belson | 2/102 |
| 4,369,526 | 1/1983 | Clutts | 2/94 |
| 4,461,411 | 7/1984 | Harrow | 224/208 |
| 4,483,469 | 11/1984 | Arisland | 2/102 |
| 4,825,471 | 5/1989 | Jennings | 2/247 |
| 5,024,360 | 6/1991 | Rodriquez | 224/215 |
| 5,142,702 | 9/1992 | Piloian | 2/102 |

*Primary Examiner*—Amy B. Vanatta

*Attorney, Agent, or Firm*—Merchant, Gould, Smith, Edell, Welter & Schmidt, P.A.

[57] ABSTRACT

A medical vest for carrying a portable patient care module is disclosed. A sleeveless vest-like portion encircles the upper torso of the wearer and has a lower edge that terminates generally at the midriff of the wearer's body. The vest portion has large neck and sleeve openings and wide straps that overlie the wearer's shoulders. The vest portion is sized for snug but slidable motion relative to the body for maximizing comfort and minimizing irritation to the skin. A pocket sized to operatively hold a patient care module such as an infusion pump or monitor is secured along an upper edge thereof to the lower edge of the vest and hangs downwardly therefrom in a loose, comfortable and unrestricted manner that does not exert constant pressure to the wearer along the length of the pocket. The vest and pocket are fabricated from soft, washable cloth that minimizes irritation to the skin.

12 Claims, 2 Drawing Sheets

MEDICAL VEST

FIELD OF THE INVENTION

This invention relates generally to patient care apparatus and more particularly to a patient garment for carrying a portable medical appliance.

BACKGROUND OF THE INVENTION

There are many situations where it is desirable and often necessary for a person to carry a portable solid object on his or her body by means that does not cause discomfort or irritation to the wearer's body. Such need is particularly acute in the medical and patient care fields and for the elderly whose skin may be particularly sensitive or susceptible to injury or irritation when subjected to prolonged pressure or contact with such object. For such persons it can become very uncomfortable or even unbearable to have a solid object such as a heart monitor, a medication injector such as an infusion pump or other intravenous injector, strapped firmly to his or her body for extended periods of time. The problem or need is particularly acute for cancer patients who are being administered to or treated by chemical injections such as chemotherapy injections or for pain killing injections such as morphine.

Such chemical injections can be administered by portable infusion pump modules sized similar to a hand-held radio or cassette player. Such infusion pumps generally provide a controlled flow of medicine to patients, and permit them a degree of mobility, and in some cases the ability to lead near normal lives, that would not be possible if the patient were otherwise connected to a nonportable pump or system. Such devices allow the patient to get out of bed and walk around and even to be cared for outside of a hospital. While some infusion pumps are implanted inside the patient's body and receive their medication by injection through a syringe, others are external and have a cassette that contains the medicine or drug and which provides the pumping injection function. Such external infusion pumps are connected to and administer their medication to the patent through a transdermal catheter (often referred to as an epidural) by means of appropriate tubing. External infusion pumps are most often preferred over surgically implanted pumps due to their ease of use, higher safety and lower installation cost. However, due to their external nature, they are necessarily more susceptible to discomfort and to possible disconnection of the exposed interconnecting tubing which is vulnerable to external forces.

The scope of such need for efficient, safe and comfortable carriers for portable patient care modules is extremely large. It is not necessarily restricted only to in-hospital patient care, but also applies to in-home patient care, as well as to nursing homes and hospice care, as well as to care for the aging or others having particularly sensitive skin. For such persons, it is not only desirable to distribute the weight of the object being carried, but is also necessary to avoid the extended prolonged engagement of the object with the wearer's skin. Previously known carriers have not adequately addressed this latter need, or have done so in a manner that is uncomfortable to the wearer.

For example, there are known carriers for solid objects such as portable continuous or periodic injectors such as infusion pumps that are in the nature of snug fitting leather belts worn around the carrier's waist, to which the injector module is secured. Such belts adequately support the module, but are uncomfortable to wear and can cause irritation to and possible breakdown of the patient's skin. Other belt, strap or harness configurations are known, but suffer from the same disadvantages. In addition, most such carriers are constructed from heavy or stiff material such as leather or canvass web or nylon belting material that is stiff and abrasive to the wearer and which is not readily washable, making such materials undesirable for patient care where frequent washing of the carrier is necessary.

Clothing configurations having pockets integrated therein or other fastening means secured thereto which could be used to carry solid objects or materials are known. However, such garments have not heretofore been particularly suitable for extended patient care use for many of the reasons stated above. In general, they are too heavy, are constructed of coarse and not readily washable material that is irritating to a patient if worn in direct contact with the skin, and are configured to hold objects carried thereby in relatively firm engagement with the wearer's body. There are also known configurations for sportswear such as sport brassiere configurations which might be used to address the issues of washability and lighter weight. However, such sportswear typically has an elastic nature that causes the garment to fit snugly and tightly to the body, which is not desirable for those with sensitive skin susceptible to irritation or breakdown due to such continuous and prolonged contact. Further, such sportswear is typically not configured to carry an object as heavy as an infusion pump or monitor module. The present invention addresses the above-described needs and shortcomings or deficiencies of the prior art.

SUMMARY OF THE INVENTION

The present invention provides a carrier for portable modules such as infusion pumps, chemical injectors, heart monitors and the like that can be comfortably worn by a person with a minimum of discomfort and irritation or pressure being applied to the person's skin. This invention provides such a carrier in the nature of a comfortable vest-like garment that is constructed of lightweight washable material that can be worn as an undergarment to street clothes, and also while in bed.

Therefore, according to one aspect of the invention there is provided a medical vest for operatively carrying and positioning a patient care module on a human body comprising:

(a) a sleeveless primary portion sized to encircle the upper torso portion of a human body and having:
  (i) continuous front and back panels defining an enlarged neck open and terminating at a lower edge adjacent the midriff area of the body, wherein the front and back panels meet below the arms of the body; and
  (ii) widened straps connecting the front and rear panels and configured to overlie the shoulders of the body;

(b) a pocket connected to the primary portion and downwardly depending from the lower edge thereof and sized and configured to retainably operatively hold a patient care module in loose movable relation to the body; and (c) the vest being constructed of soft, washable material and being configured to be slidably movable relative to the body for minimizing irritation and chaffing of the body skin.

The medical vest preferably has a separable opening formed in the primary portion thereof for enabling the vest to be placed on and removed from the body. While the vest can be constructed of any soft washable material, preferable materials are cotton or silk. The pocket for holding the patient care module can be operatively positioned virtually anywhere along the lower edge of the primary portion, in order to place the patient care module in its best operative position relative to the body and for maximizing comfort to the wearer.

According to yet another aspect of the invention there is provided a carrier garment to be worn on a body for carrying a portable patient care module comprising:

(a) a wide continuous upper body portion for encircling the body torso and terminating at a lower edge adjacent the midriff area of the body and defining enlarged holes for arm and neck openings, wherein the body portion is sized for snug but slidable motion relative to the body; and (b) a pocket secured along an upper edge thereof to the lower edge of the upper body portion, which is sized and configured to retainably operatively hold a patient care module in a loose slidable manner relative to the body.

According to yet a further aspect of the invention there is provided a personal carrier for a portable medical appliance, comprising:

(a) a pocket for retainably operatively holding the portable appliance; and (b) means for mounting the pocket to a human body in a manner such that the majority of the pocket is movable with respect to the body and such that the weight of the appliance held by the pocket is distributed over the shoulder area of the body, with the pocket mounting means being relatively freely slidable with respect to the body.

While the preferred embodiment of the present invention will be illustrated with regard to a particular vest-like garment configuration thereof, it will be understood that other shapes and configurations of the invention will apply within the broad scope of the invention. Also, while the invention will be illustrated preferably for its use in carrying an infusion pump module, it will be understood that the invention applies equally well to other types of patient care modules or simply to generally solid or relatively heavy items in general such as batteries or the like. Further, while the invention will be described as fabricated from the preferred materials of cotton and silk, the invention is not to be limited solely to the use of such materials. Further, while the invention will be described with respect to preferred positioning of its pocket or pouch portion that carries the portable module, and with respect to a particular method of fastening the pocket to the upper body portion of the garment, the invention is not to be limited to the described preferred positioning or methods of attachment of the pocket. Similarly, while the invention will be described with respect to a particular positioning and manner of closure and fastener means associated therewith for enabling the garment to be readily secured and removed from a wearer, the invention is not to be limited by any of the specifics thereof as illustrated with respect to the preferred embodiment of the invention. Rather, all alternatives that fall within the broad scope of the appended claims are to be included within the scope of the invention.

BRIEF DESCRIPTION OF THE DRAWING

Referring to the figures, wherein like numerals represent like parts throughout the several views.

DESCRIPTION OF THE PREFERRED EMBODIMENT

Figure 1:
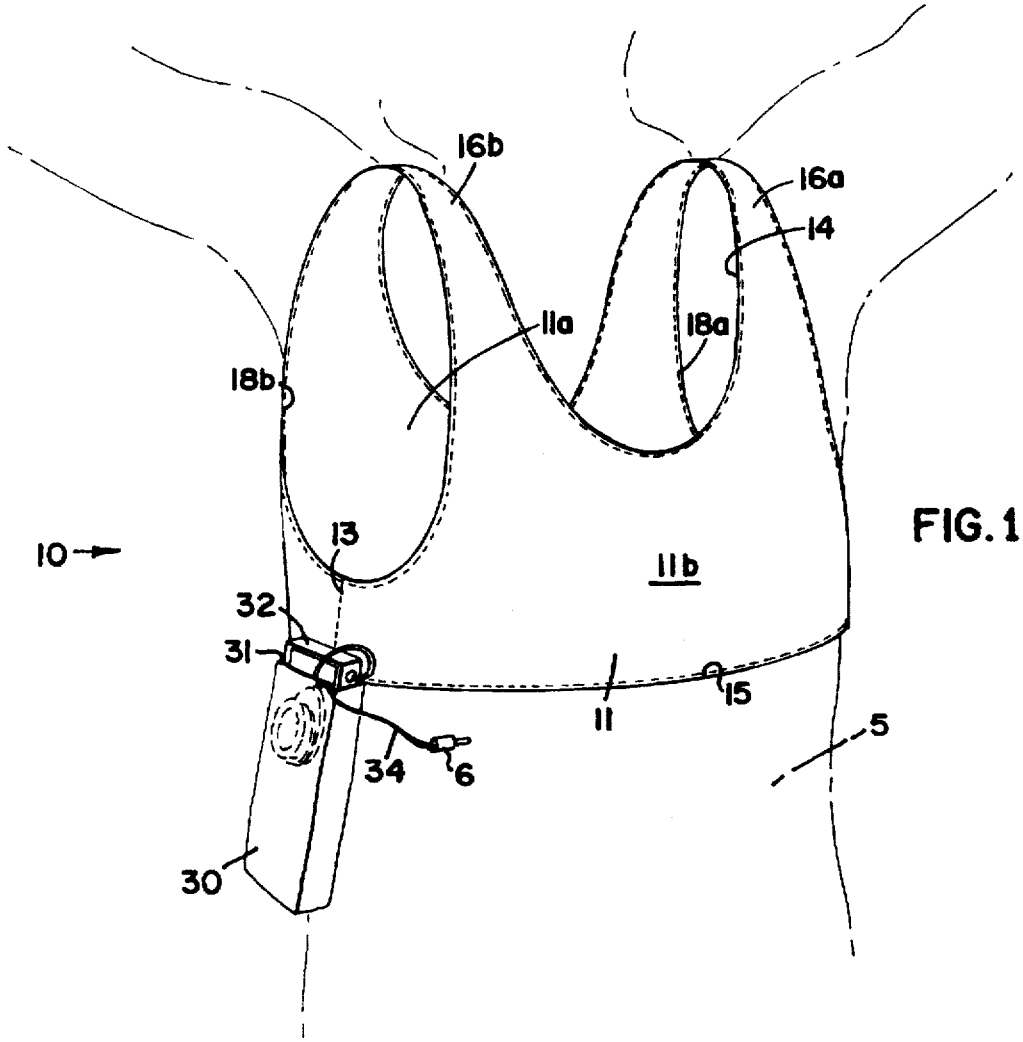
FIG. 1 is a perspective view generally viewed from the back left angle of a medical vest configured according to the principles of this invention, illustrating the vest as it would operatively appear on the body of its wearer.
Figure 2:
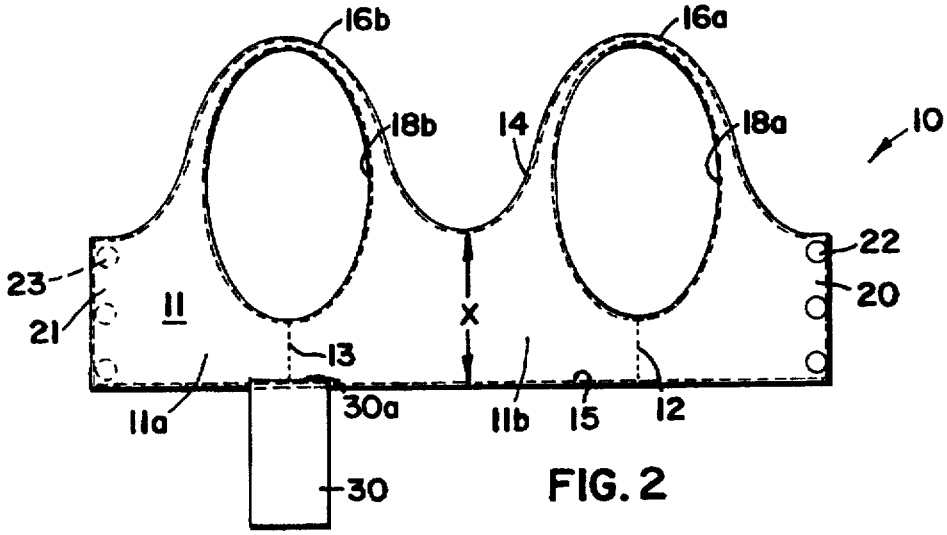
FIG. 2 is a back view of the medical vest of FIG. 1, illustrating the vest as it would generally appear when opened at its front and removed from the body and positioned in a generally flat configuration.

A first embodiment of a carrier garment configured according to the principles of this invention is generally illustrated at 10 in FIGS. 1 and 2 as it would appear when operatively positioned on and carried by a human body 5. In the preferred embodiment, the carrier is configured generally in the nature of a sleeveless vest-shaped garment. The carrier has a primary body portion 11. In the preferred embodiment the body portion 11 is formed by front and back panel portions **11*a* and 11*b* respectively, sewn together by a straight seam at and along their longitudinal edges at 12 and 13, to form a continuous body panel that encircles the upper chest or torso portion of the wearer. In the preferred embodiment, the primary body portion defining the front and back panels is actually cut from a single piece of material and is shaped with a cutout portion defining an enlarged neck opening 14 bordered by a pair of shoulder straps 16*a* and 16*b*. The straps 16** are sufficiently wide, from about 1.5 to 2.5 inches in width in the preferred embodiment, to evenly and comfortably dissipate the weight carried by the garment over the wearer's shoulder area, and in a manner that will readily enable the straps to comfortably slide over and relative to the wearer's shoulders. The strap width will obviously vary with the size of the garment. For children's sizes the strap width will be narrower, while adult sized garments will have larger width straps. Alternatively, the primary body portion could be configured with straps that are sewn to the front and back panels; however, the single piece construction eliminates seams on the front and back panels to which the straps would be connected, that could represent a source of irritation to the wearer—especially in those areas of the garment that are subjected to the most force or pressure from the article whose weight is being carried.

As sewn together at seams 12 and 13, the primary body portion 11 also defines a pair of arm openings **18*a* and 18*b* overlying the seams 12 and 13 respectively. The arm openings 18 are configured fairly large so as to provide virtually unrestricted arm movement of the wearer, and minimize contact and binding of the primary body portion 11** with the wearer's skin beneath the arms.

It is anticipated that the primary body member 11 will be fabricated in multiple sizes to accommodate differing body sizes and shapes. In general, when operatively positioned for wear on a body 5, the body member 11 should preferably fit in close, but loose sliding engagement with the body, but not so loose so as to have excessive sag or to cause distortive pulling or binding of the carrier garment 10 when the object being carried thereby is operatively in place.

In the preferred embodiment illustrated, the front panel **11*a* is split at its center and defines first and second ends 20 and 21, which open and cooperatively address one another to allow the carrier to be positioned on the wearer in shirt or vest-like manner, well-known in the art. In the preferred embodiment, the ends 20 and 21 are selectively fastened by means of eye and hook fastener members commonly sold under the Velcro® trademark. In the preferred embodiment, a plurality of circularly shaped such hook fastener portions 22 are affixed to the outer surface of the panel 11***a* at the first end 20, and a plurality of mating eye fastener members 23 are cooperatively aligned along the inside surface of the panel 11a at the second edge 21 for cooperative mating engagement with the hook fasteners 22, in a manner well-known in the art. It will be understood by those skilled in the art, that while a plurality of individual fastener members 22 and 23 have been been illustrated with respect to the preferred embodiment, such fastener function could be performed by a single continuous strip fastening structure or by fasteners other than the Velcro® type eye and hook fastening mechanism. With respect to such fastening scheme, whatever type may be used, however, it is important to ensure that the materials or means which provide the fastening function do not come into direct engagement with the wearer's skin so as to cause irritation thereto.

The primary body portion 11 terminates at its lower portion along a lower edge 15 that, in the preferred embodiment, is generally at a height when positioned on the wearer that corresponds with the upper midriff area of the wearer that lies generally along and below the lower rib cage of the body torso. The midriff extends downwardly to a lower area generally adjacent the waist of the body torso and above the hip area. Such midriff portion of the torso provides a natural indented region that accommodates carrying of a solid object in a pocket, as hereinafter described in more detail, with minimum discomfort to the wearer. In the preferred embodiment, all edges of the primary body portion 11 of the carrier garment are hemmed or edge seamed to prevent unraveling, by means of a simple stitch pattern that is determined to provide minimum irritation to the wearer's skin.

A pocket 30, preferably of the same material from which the primary body portion 11 is constructed, is sewn along its upper rear edge 30*a* to the lower edge 15 of the primary body portion 11 and downwardly depends therefrom in otherwise loose manner for free sliding movement relative to the body of the wearer. The pocket 30 defines an inner cavity 31 open at its top and sized and configured to retainably hold an infusion pump or injection module or monitor or the like (generally illustrated at 32) for administering to the unique needs of the wearer. The lateral position of the pocket 30 along the lower edge 15 of the upper body portion 11 could be anywhere therealong, but most preferably is at either "side" of the upper body portion 11 underlying the arms of the wearer (i.e., under the seams 12 or 13), or somewhere along the lower edge 15 of the front panel portion 11a of the upper body member 11. The actual "position" of securement of the pocket 30 to the upper body portion 11 will generally be dictated by the particular use to which the pocket 30 is put. For example, for the embodiment illustrated in FIGS. 1 and 2, the pocket is designed to hold an infusion pump module of the type used by cancer patients who have a surgically implanted epidural tube 6 leading to the spine area, it is preferable to have the pocket member positioned along that side portion of the garment closest to the epidural so as to minimize the length of tubing extending from the injector module carried by the pocket to the epidural, and also such that the wearer can comfortably lie on his or her back without laying on or pulling the cord extending from the injector module. Positioning of the pocket along the front lower edge of the upper body portion 11 may be preferable in those instances wherein the wearer or person maintaining the carried module may need to have ready physical access to the module, or in situations wherein the tubing or wires leading from the module may require extension up to the neck area of the wearer, such as may be the case for portable catheters or the like. An example of such tubing leading to the neck area is indicated at 33 in FIG. 3. It is also preferable to have the pocket sized and configured to retainably carry or hold any excess tubing or wires that may be associated with the injector or monitor module. In FIGS. 1 and 2, such a monitor or injection module is illustrated generally at 32 with its associated wires or tubing extending to an epidural 6 located in the patient's back area indicated at 34. The pocket 30 is appropriately shaped to accommodate relatively unimpeded egress of the tubing or wires therefrom, whether such egress is from the top portion of the pocket or through the sides or front. In the embodiment illustrated, the pocket is simply open at its top end to enable egress of the tubing therethrough. Preferably such egress would not be through the back portion thereof so as to minimize frictional contact of the tubing directly with the wearer's skin. Since the pocket 30 is only secured along its top inside portion thereof, the lower downwardly depending portion of the pocket is free to slide and move relative to the wearer's body, and does not apply any prolonged constant force or pressure to the wearer's body from the module 32, thereby minimizing irritation to and breakdown of the wearer—s skin where occasional contact is made with pocket.

Figure 3:
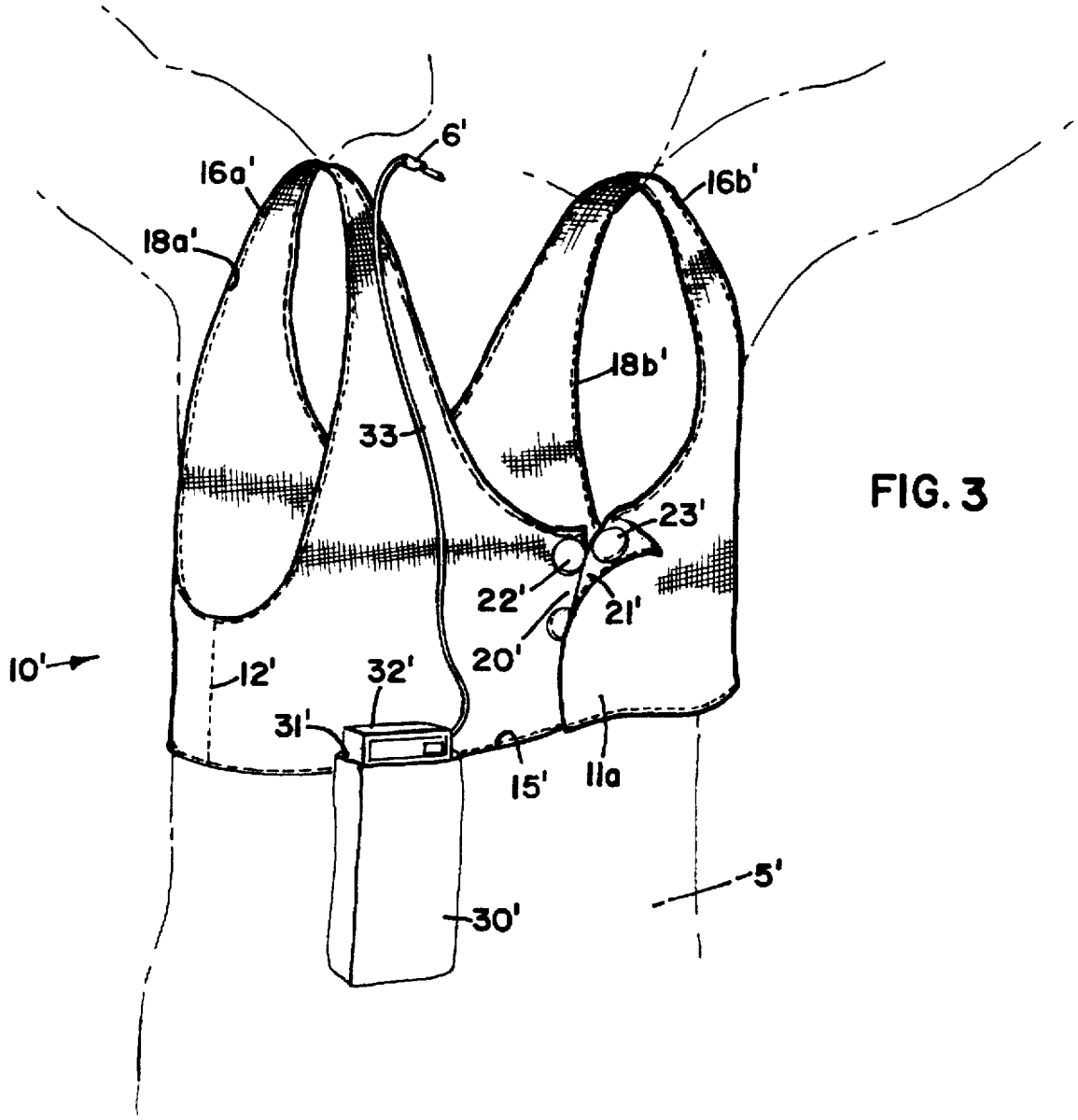
FIG. 3 is a perspective view as generally viewed from the right front angle of a second embodiment of a medical vest configured according to the principles of this invention, illustrated as it might appear when operatively positioned upon a body of its wearer.

In the second embodiment of the invention illustrated in FIG. 3, wherein like parts of the medical vest previously illustrated in FIGS. 1 and 2 are denoted by the same reference numerals followed by a prime (') designation, the pocket 30' is illustrated as generally positioned as depending from the front lower edge 15' of the upper body portion. The tubing 33 leading from the module 32' is illustrated as extending upwardly to an epidural in the neck region of the wearer's body. It will be appreciated that the position of the pocket could be anywhere along the lower edge 15 of the upper vest portion as dictated by the intended use of the module being held by the pocket.

In the preferred embodiment, both the primary upper portion 11 and the pocket 30 of the garment carrier are made from the same material. Such material is preferably soft and washable material such as a finer woven cotton or silk which breathes easily, but could include some elastic spandex material. The material should be suitably durable and able to repeatedly withstand sanitized washing operations. The primary concern is that such material be comfortable to the wearer and provide for some degree of slidable contact with the wearer's skin as opposed to a material that would cause the garment to fixedly engage the wearer's skin without movement. It is preferable that the secured position of the pocket 30 be at or slightly higher than the wearer's waist so as to provide ready access for any tubes or wires leading from the module 32 carried by the pocket to the patient's/wearer's body 5, and also for enabling the module carried by the pocket to be carried at a position which is most comfortable for the wearer and least likely to protrude outwardly from the wearer's body where it may be easily bumped, snagged or interfered with as a result of normal movement activities of the wearer. While the pocket 30 has been illustrated as being directly sewn to the primary body portion 11, a garment could be configured in a manner such that the relative position of the pocket 30 along the lower edge 15 of the upper body portion 11 could be selectably moved and secured thereto as for example by appropriate fasteners such as snaps or eye and hook fasteners or the like.

In the preferred embodiment garment illustrated, the "height" of the back portion of the garment (indicated at "X") is approximately 9 inches, whereas the height of material at the seam area 12 and 13 under the arms of the wearer is approximately 4 inches. For an application using an infusion pump such as might be used for a cancer patient, a pocket size of approximately 5 inches in width and 9 inches in height is preferred. It will be understood, however, that the invention is certainly not to be limited by such dimensions as used with the preferred embodiment garment, but that all alternatives and variations which otherwise satisfy the broad principles and objectives of the invention, are possible within the broad scope of the invention.

In the foregoing, it will be appreciated that a garment carrier for a portable module has been described that provides a better, safer and more comfortable manner of wearing and carrying such module. The carrier garment is easy to put on and take off and is readily washable. Since it may be worn as an undergarment under loose clothing, it gives the wearer more freedom to move about in an unobtrusive manner. While the carrier garment has been described with respect to a particular preferred embodiment thereof, and with respect to specific types of modules to be carried thereby and with respect to particular materials to be used for its construction. It will be understood by those skilled in the art that the invention is not to be limited in any manner by the specifics described with respect to the preferred embodiment. The preferred embodiment has been described to illustrate a clear example of how the principles of the invention can be specifically applied to a garment carrier for a portable module. All alternatives and modifications of the foregoing are intended to be covered within the broad scope of the appended claims.

What is claimed is:

1. A medical vest for operatively carrying and positioning for comfort a patient care module on a human body having an upper torso defining a midriff area extending from an upper area adjacent a lower rib cage of the torso to a lower area adjacent a waist portion of the torso, comprising:

(a) a sleeveless primary portion sized to encircle the upper torso and having:

(i) continuous front and back panels cooperatcively defining an enlarged neck opening and sized and configured to terminate at a lower edge adjacent the upper area of said midriff, said front and back panels meeting and being joined at oppositely disposed sides below the arms of the body; and (ii) widened straps connecting the front and rear panels and configured to overlie the shoulders of the body;

(b) a pocket connected to said primary portion at one of said aides go am to be positioned generally under an arm of said body, said pocket downwardly depending from said lower edge to a distal end and being, sized and configured to retainably operatively hold a patient care module in loose movable relation to the body and such that said distal end lies generally along said lower area of said midriff; and (c) said vest being constructed of soft, washable material for minimizing irritation and chafing of the body skin and in a manner so as to minimize irritation of stitchings of said vest to the body, and being configured to be slidably movable relative to the body.

2. The medical vest as recited in claim 1, wherein the primary portion has a separation for enabling placement and removal of the vest on the body; and wherein said primary portion includes fastener means for releasably fastening the separation.

3. The medical vest as recited in claim 1, wherein said material comprises finely woven cotton.

4. The medical vest as recited in claim 1, wherein said material comprises silk.

5. The medical vest as recited in claim 1, wherein said pocket is secured along an upper portion thereof to said lower edge of said primary portion.

6. The medical vest as recited in claim 1, wherein said pocket is sized to retainably hold an infusion pump injector module and excess tubing associated with said module.

7. A carrier medical garment to be worn on a body for carrying a portable patient care module, comprising:

(a) a continuous wide upper body portion for circumferentially encircling the body torso and terminating at a lower edge adjacent an upper midriff area of the body and defining enlarged holes for arm and neck openings, said body portion being sized for snug but ready slidable motion relative to the body; said upper midriff area extending downwardly from a lower rib cage area of the body; and (b) an open pocket secured along an upper edge thereof to said lower edge of said upper body portion and downwardly depending therefrom along a side of said midriff area, said pocket being sized and configured to retainably operatively hold a patient care module in a loose slidable manner relative to said body and generally above a waist of the body.

8. A carrier garment as recited in claim 7, wherein said body portion and said pocket are constructed of the same material.

9. The carrier garment as recited in claim 8, wherein said material is a soft, washable material of a nature that minimizes irritation of skin of said body when said material is in direct contact with said skin.

10. The personal carrier as recited in claim 7, wherein said mounting means secures said pocket along an upper edge of said pocket in a manner such that said pocket is otherwise free to move about said upper edge.

11. The personal carrier as recited in claim 7, wherein said upper body portion is configured generally in the shape of a vest.

12. The medical vest as recited in claim 1, wherein said front and back panels are seamless except for where they are joined at said sides, and except for peripheral edge stitching.

* * * * *

UNITED STATES PATENT AND TRADEMARK OFFICE

CERTIFICATE OF CORRECTION

PATENT NO. : 5,708,978

DATED : JANUARY 20, 1998

INVENTOR(S) : JOHNSRUD

It is certified that error appears in the above-identified patent and that said Letters Patent is hereby corrected as shown below:

Col. 6, line 27: "wearer–s" should read —wearer's—

Col. 7, line 51: "aides go am" should read —sides so as—

Signed and Sealed this

Twenty-ninth Day of February, 2000

*Attest:*

Q. TODD DICKINSON

*Attesting Officer*

*Commissioner of Patents and Trademarks*